US006688144B2

(12) United States Patent
Nishikawa et al.

(10) Patent No.: US 6,688,144 B2
(45) Date of Patent: Feb. 10, 2004

(54) KNIT DESIGN SYSTEM

(75) Inventors: Fumihiro Nishikawa, Wakayama (JP); Hiroyuki Okazaki, Wakayama (JP); Akira Ueno, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/398,944

(22) PCT Filed: Oct. 15, 2001

(86) PCT No.: PCT/JP01/09058

§ 371 (c)(1),
(2), (4) Date: Apr. 11, 2003

(87) PCT Pub. No.: WO02/33598

PCT Pub. Date: Apr. 25, 2002

(65) Prior Publication Data

US 2003/0191552 A1 Oct. 9, 2003

(30) Foreign Application Priority Data

Oct. 18, 2000 (JP) ..... 2000-318533

(51) Int. Cl.[7] ..... D04B 15/78

(52) U.S. Cl. ..... 66/232; 66/237; 700/141

(58) Field of Search ..... 66/231, 232, 237, 66/60 R; 700/155, 97, 130, 131, 141, 143; 702/152

(56) References Cited

U.S. PATENT DOCUMENTS 5,754,431 A * 5/1998 Kotaki ..... 700/97
5,757,661 A * 5/1998 Surville ..... 702/155
5,987,931 A * 11/1999 Takahashi ..... 66/75.1

FOREIGN PATENT DOCUMENTS

JP 8-511588 A 12/1996
JP 9-78411 A 3/1997

* cited by examiner

*Primary Examiner*—Danny Worrell
(74) *Attorney, Agent, or Firm*—Rothwell, Figg, Ernst & Manbeck

(57) ABSTRACT

A knit design system comprising grading line directing device (24) for directing grading lines (48, 90) at locations of size changes with respect to a design (34, 86) displayed on a monitor (8); grading line setting device (28) for setting information on design modification (34, 86) with respect to the grading lines (48, 90); operating device (26) for making size changes of the design (34, 86) with reference to the grading line (48, 90) directed by the grading line directing device (24) and the modification data set by the grading line setting device (28).

3 Claims, 9 Drawing Sheets

84

SIZE LIST

| PLACE | DIRECTION | FINISH | DIFFERENCE |
|---|---|---|---|
| BODY LENGTH | 50 | 50 | 0 |
| ARMHOLE | 19.0 | 21.0 | 2.0 |

KNIT DESIGN SYSTEM

TECHNICAL FIELD

The present invention relates to a knit design system for creating a design of a knitted fabric knitted with a flat knitting machine. More particularly, the present invention relates to a knit design system for creating a design of a seamless knitted fabric which is knitted in such a manner that its sleeves and bodies are joined seamlessly.

BACKGROUND ART

A seamless knitted fabric, such as a sweater and a one-piece, is knitted seamlessly in such a manner that both sleeves are knitted in a tubular form in parallel with a front body and a back body and, thereafter, the both sleeves are joined to the bodies. Then, the bodies are knitted up to the shoulder and joined together at the shoulder. If necessary, some process is given to a collar portion or other portions of the knitted fabric. The seamless knitting is ended after this manner.

When this seamless knitted fabric is knitted with a flat knitting machine, a knit design system is used to create a design of basic knitting data, while monitoring the design displayed on a monitor. The design data created, including the data on the front body, back body, and sleeves, is represented on the monitor in such a way that the sleeves are arranged in parallel with the front body and back body and also are joined thereto at points at which the joining work is started. When the design of the seamless knitted fabric is created, constraints on the design of the sleeves around armholes of the front body and back body to which the sleeves are joined must be taken into consideration.

When the design of the seamless knitted fabric thus created is changed in size or resized, an operator displays the design to be changed in size on the monitor, first, and, then, directs the locations of the size changes and inserts in the design a space corresponding to a desired number of stitches in a widthwise or lengthwise direction of the locations or deletes the data, to increase or decrease the size of the design. In order to keep continuity of the pattern of the design, a basic knitting pattern is depicted in the space inserted in the design when the size is increased.

After the design is changed in size or resized by inserting or deleting the data of the design in the widthwise or lengthwise direction of the locations, if there are any locations at which the design loses its outline shape and an irregular profile line appears, the operator amend such an irregular line into a regular profile line.

When the design of the seamless knitted fabric is changed in size or resized, the operator must consider, for example, on how many stitches in the real knitted fabric is increased or decreased by the desired size changes of the design, or conversely, on to what extent the design is changed in size by the insertion or deletion of the data on a certain number of stitches. In particular, the operator must satisfy the joining conditions to allow for the design shape of the sleeves.

Further, when a knitting pattern of the basic pattern at a ground of the knitted fabric is a repetitious knitting pattern, like a wide rib, the operator must comprehend the pitch at which the knitting pattern is repeated and also must consider constraints on the knitting and information on the knitting structure, in order not to render the continuity of the repetitious knitting pattern discontinuous, before he/she changes the design in size.

Thus, when the design of the seamless knitted fabric is changed in size or resized, the operator must amend the locations of size changes separately, while considering the constraints on the knitting and the information on the knitting structure, thus requiring proficient knowledge, lots of troublesome works and time.

It is an object of the present invention to provide a knit design system that can facilitate the size changes of the design of a knit product.

DISCLOSURE OF THE INVENTION

The present invention is directed to a novel knit design system capability of displaying a design of a knit product on a monitor to make size changes of the design, the knit design system comprising: grading line directing means for directing grading lines at locations of size changes with respect to the design displayed on the monitor; grading line setting means for setting information on design modification with respect to the grading lines directed by the grading line directing means; and operating means for making size changes of the design with reference to the grading line directed by the grading line directing means and the modification data set by the grading line setting means.

It is preferable that the grading line setting means allows correlation of the grading lines that are mutually affected by the size changes among the grading lines directed by the grading line directing means and also allows a setting of a ratio of deviation for each of the correlated grading lines.

It is preferable that the knit design system further comprises profile line transforming means for transforming an irregular profile line in an area of the design changed in size by the operating means to a regular profile line.

Also, it is preferable that the knit design system further comprises pattern drawing means for depicting a pattern in the area of the design at the pattern side of the transformed profile line with reference with the basic pattern of the pattern of the design after the profile line of the design is transformed by the profile line transforming means.

BEST MODE FOR CARRYING OF THE INVENTION

Figure 1:
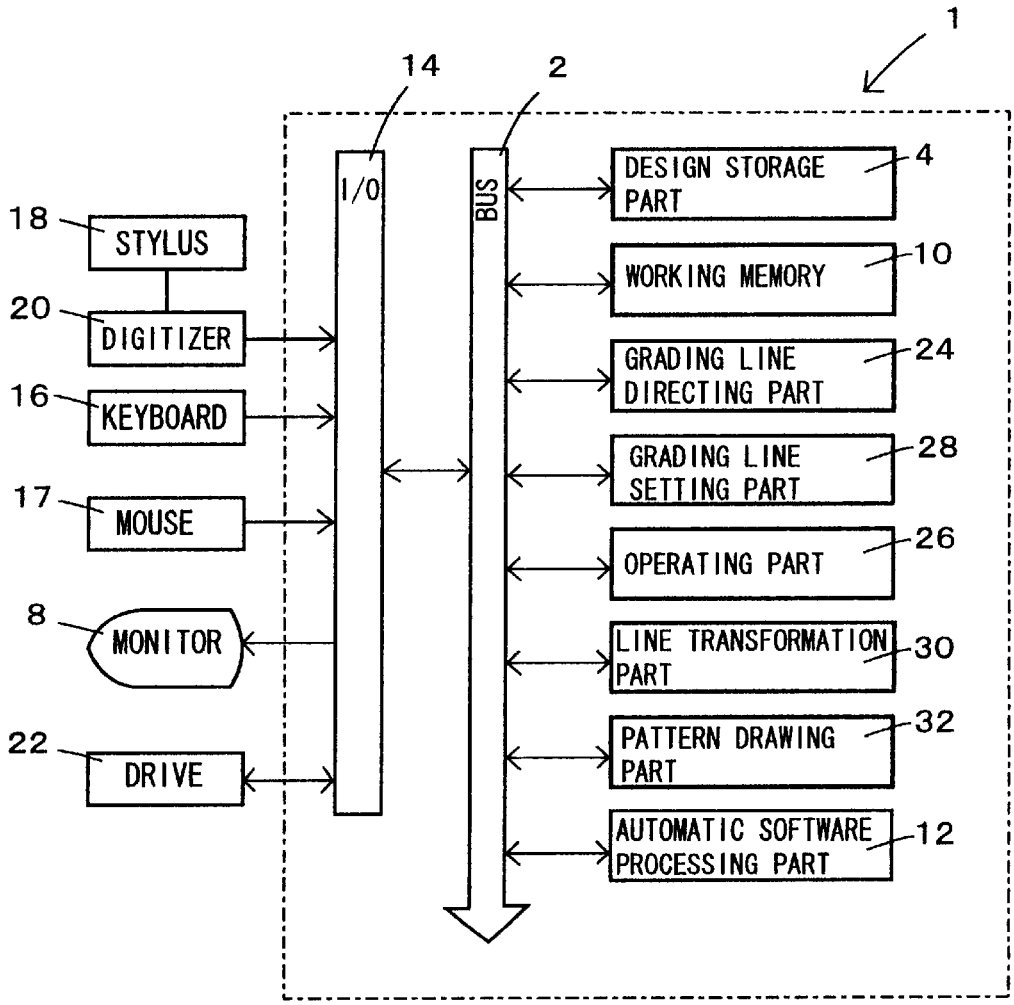
FIG. 1 is a block diagram of a knit design system of the present invention.

Certain preferred embodiments of the present invention will be described with reference to the accompanying drawings. FIG. 1 is a block diagram of a knit design system 1 of the present invention. This knit design system 1 has the capabilities of creating a design of a seamless knitted fabric and allowing size changes of the design. 2 denotes a bus, which is illustrated in the form of a single bus, with no distinction between a data bus and instruction buses other than that. 4 denotes a design storage part for storing design data of the seamless knitted fabric. The design data contained in the storage part 4 stores each loop in the form of a single pixel and provides a bit wide to store the data on stitch structures, racking directions and distances, etc.

The design data can be interpreted as color data. In the embodiment, the design data is displayed in the form of color data on a monitor 8. The design data may be displayed in any form. For example, the design data may be in the form of color data or color code, or in other forms such as character symbols. When the design data is displayed on the monitor 8, each loop is represented by the single pixel. As for pattern structures requiring some courses for knitting a single loop by loop transfer, like a narrowing pattern and a widening pattern, each of the loops can be represented by single pixel by recording the knitting sequence as a package pattern in advance.

10 denotes a working memory for storing intermediate data and the like in the process of an arithmetical operation. 12 denotes an automatic software processing part for converting a created design data to a knitting data for a knitting machine. In the design system 1, the design data stored in the design storage part 4 is converted to the knitting data in the automatic software processing part 12 and fed to the knitting machine to knit a fabric.

14 denotes an I/O device. It is connected with the monitor 8 for displaying an image thereon, a keyboard 16 and a mouse 17 for inputting numeric values and commands, a digitizer 20 for entering outer inputting coordinate points with a stylus pen 18, and a disc drive 22 for inputting existing design data and outputting the knitting data converted in the automatic software processing part 12.

24 denotes a grading line directing part in which a location of size change in the design stored in the design storage part 4 as displayed on the monitor 8 is directed or pointed with the stylus pen 18 to specify the grading line in the X axis or the Y axis of the directed location.

The grading line specified in the X-axis serves as a grading line of reference, with reference to which the design is changed in size with respect to the lengthwise direction thereof in an operating part 26 mentioned later. On the other hand, the grading line specified in the Y-axis serves as a grading line of reference, with reference to which the design is changed in size with respect to the widthwise direction thereof.

28 denotes a grading line setting part for setting the information on the design to be modified with reference to the specified grading lines in the X-axis and Y-axis at the location directed by the grading line directing part 24. In this grading line setting part 28, the data to be inserted or deleted is set with reference to the grading lines specified on the design displayed on the monitor 8 and the pattern pitch of the knitted fabric to be inserted or deleted are also set.

When a multiple grading lines which are affected mutually in such a way that the size change made by one grading line will exert an influence on the size change made by the other grading line are directed, those multiple grading lines are correlated with each other as a group and also a ratio of deviation resulting from the size changes is set for the correlated multiple grading lines. This can allow an automatic calculation of a revised value of the other grading line on the design system side by setting a revised value of any one of the correlated multiple grading lines.

In this embodiment, the number of gauges of the knitted fabric can be calculated or input to estimate to what extent the design is to be changed in size by entering the number of loops to be changed in accordance with the size changes of the design as well as by entering a desired size of the knitted fabric to be changed.

26 denotes the operating part for allowing the size changes of the design in accordance with the information on design modification set in the grading line setting part 28 with reference to the grading lines directed in the grading line directing part 24.

30 denotes a line transforming part for allowing line transformation of the design in such a way that an irregular profile line can be transformed to a regular profile line at a location at which the irregular profile line of the design is caused by the size changes of the design in the operating part 26. In the embodiment, a desired profile line is configured in such a way that a pitch in the X-axis and a minimum pitch in the Y-axis of at least one line forming the profile line in the specified design area are set and also a pitch in the X-axis and a pitch in the Y-axis of a ground part of the knitted fabric are set as information on a basic pattern of the pattern of the knitted fabric, followed by transformation of an irregular profile line of the design to a regular profile line on the basis of the set pitches.

32 denotes a pattern drawing part. If a modified design part whose profile line is transformed to the regular profile line by the line transforming part 30 has, at a pattern side of the profile line, an area where no data is input, then that area is filled in with a pattern with reference with the basic pattern information of the fabric set in the line transforming process by the pattern drawing part 32.

The size change process of the design carried out in the knit design system 1 will be described with reference to FIGS. 2–11.

Figure 2:
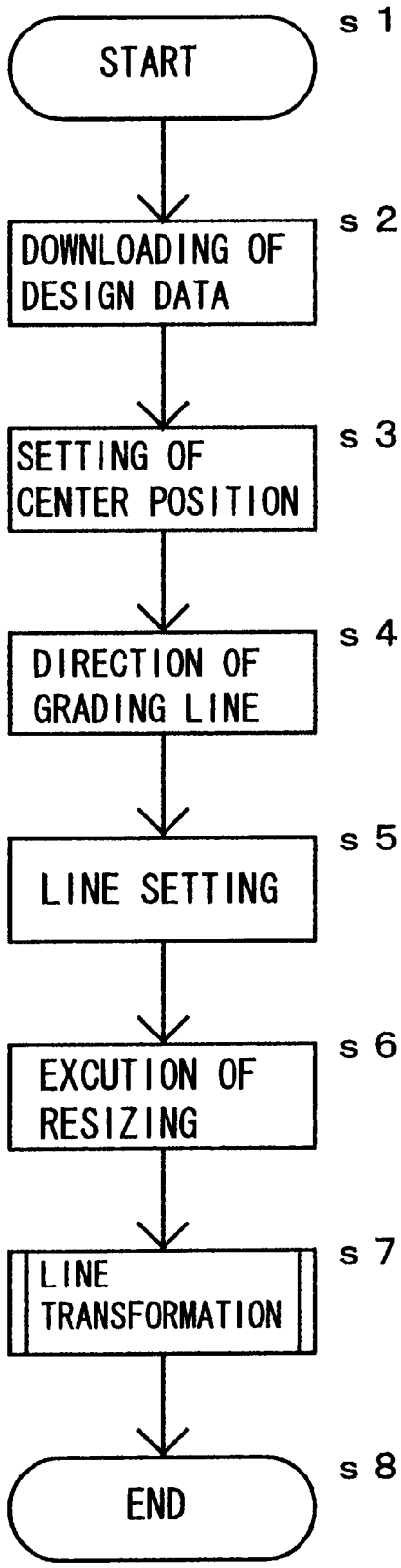
FIG. 2 is a flow chart of a size change process in the knit design system of FIG. 1.

FIG. 2 shows a flowchart of the size change process. In the step s1, the size change process is started.

In the step s2, the data of the design to be changed in size is read and the design is displayed on the monitor 8. The design data already drafted is read from the design storage part 4 or from the disc drive 22 or equivalent.

Figure 3:
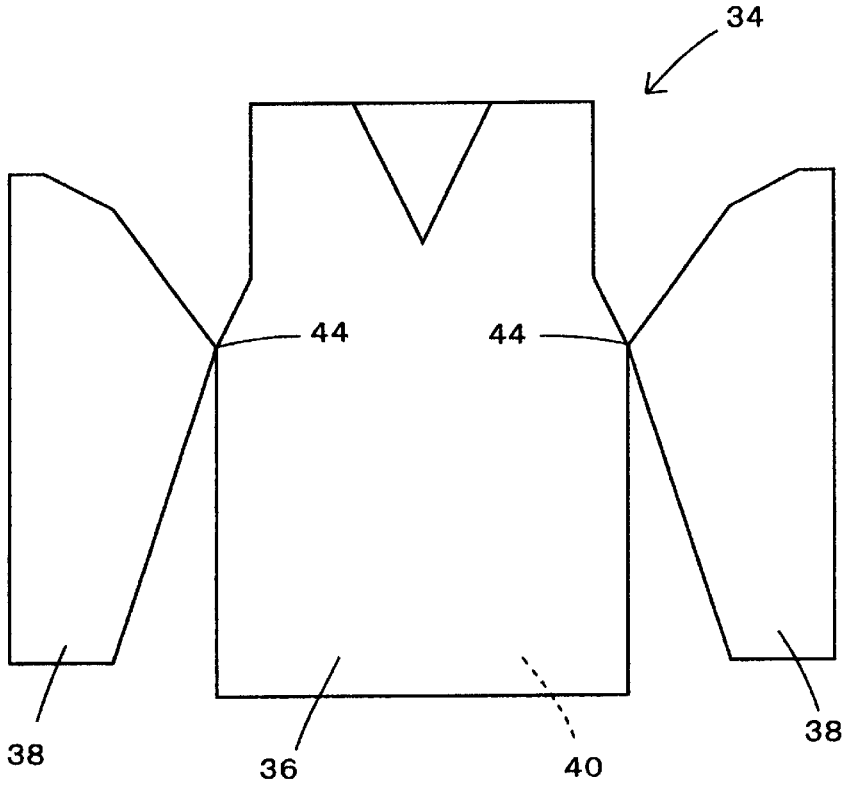
FIG. 3 shows a design of a seamless knitted fabric to be resized.

The design data read in this embodiment is the data of a design 34 of a sweater of a seamless knitted fabric as shown in FIG. 3. The design data is represented on the monitor 8 in such a way that sleeves 38 are arranged in parallel with a front body 36 and a back body 40 and also are joined thereto at points 44 at which the joining work is started.

In the next step s3, when the design 34 has a symmetrical shape, a center position 46 of the pattern is set so that a mirror process of the design can be made. This can allow both sides of the symmetrical design 34 to be modified simultaneously by simply modifying an either side of the design 34 with respect to the center position. The center position may be set by the operator or may alternatively be set automatically in the design system 1.

In the step s4, grading lines made by the grading line directing part 24 are superimposed over the design 34 of FIG. 3 at the locations of size changes displayed on the monitor 8.

Figure 4:
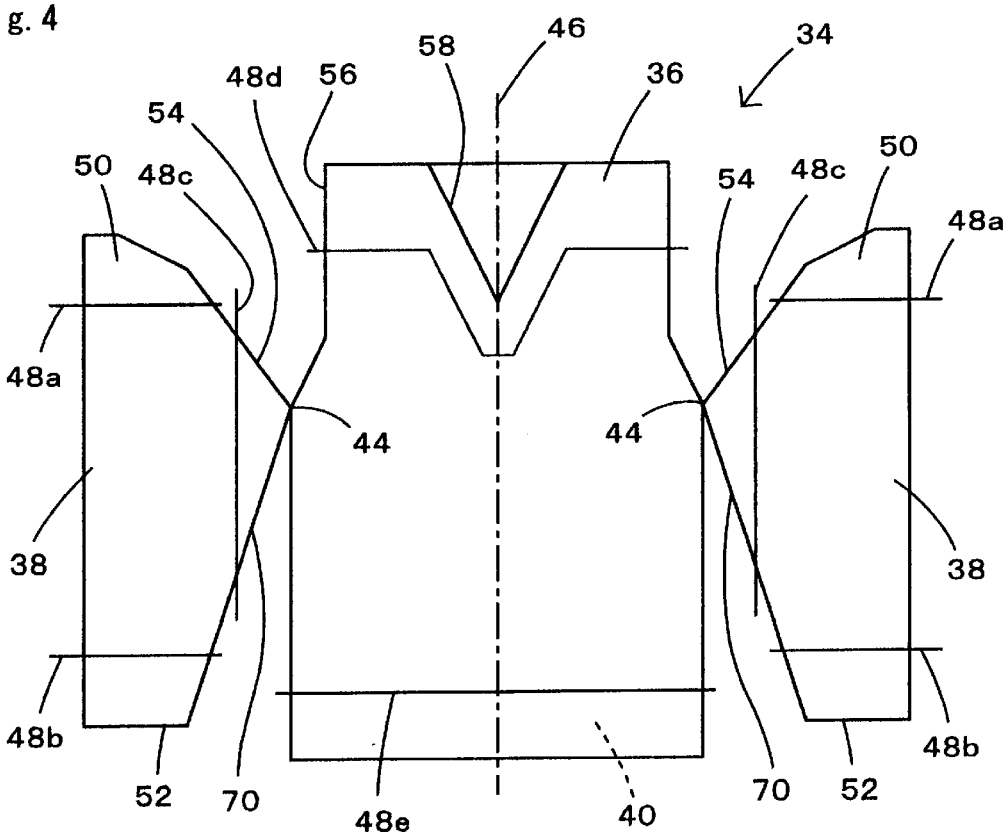
FIG. 4 shows representation of a grading line superimposed over the design to be resized.

In this embodiment, in order to increase the size of the design 34, the locations of a desired size changes are directed or pointed with a stylus pen 18 to specify the grading lines 48 with respect to the X-axis or the Y-axis of the directed location. FIG. 4 shows representation of the grading lines 48 superimposed over the design 34 to be changed in size.

In FIG. 4, a grading line 48*a* and a grading line 48*b* are grading lines specified to increase the sleeve length. The grading line 48*a* is specified to be in a sleeve cap 50 and the grading line 48*b* is specified to be below the sleeve cap 50.

A grading line 48*c* is a grading line to increase a sleeve width. In the illustration, the grading line 48*c* is specified to be between a cuff 52 and a joint starting point 44, so as to keep the cuff width unchanged. A grading line 48*d* and a grading line 48*e* are grading lines to increase a body length of the front body and a body length of the back body. The grading line 48*d* is specified to run between armholes 56 of the bodies 36, 40 to be joined to the narrowing parts 54 of the sleeves. The grading line 48*d* is specified to be below a neckline 58 at the center portion of the body, so as to prevent from being superimposed over the neckline 58.

Figure 5:
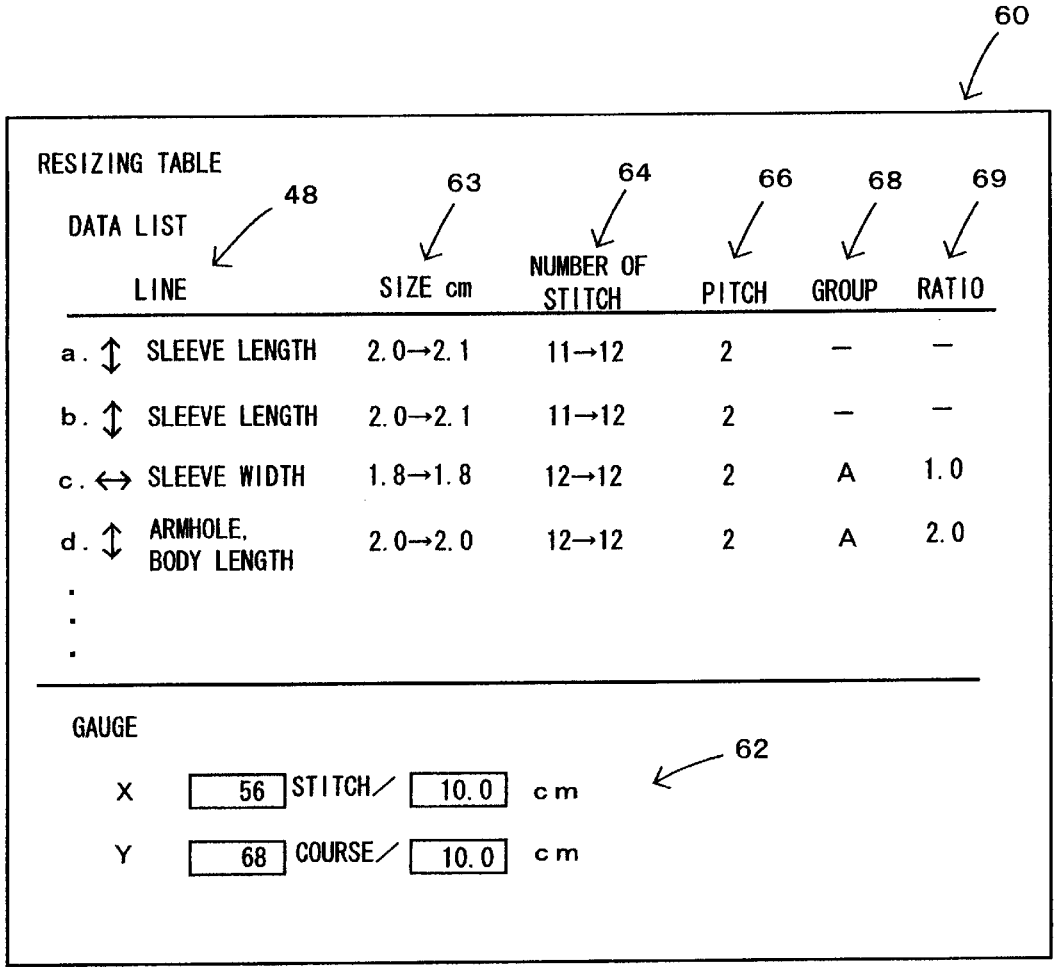
FIG. 5 shows a resizing table used for setting the information on modification of design with respect to the grading line.

In the next step s5, information to modify the design 34 is set with respect to the respective grading lines 48 specified in the step s4. FIG. 5 shows a resizing table for this setting of information. The resizing table 50 can allow the setting of the gauge of the knitted fabric. The number of gauges is calculated by entering the number of loops in a vertical or horizontal direction per any selected size. Accordingly, when modification values are set with respect to the respective grading lines 48, an amount of data to be inserted or deleted can be specified not only by entering the number of loops but also by entering the size (e.g. cm).

In the resizing table 60, the values at the left side of the size item 63 and number-of-stitch item 64 are desired values of size changes and the values at the right side of the same are actual values allowing for the pitches mentioned later. The values to be set in the pitch item 66 are values of a minimum unit of the repeated pattern of the design data 34 in and from which the data is inserted and deleted. The multiple grading lines 48 at the group item 68 which are affected mutually by the modification of the design data 34 made by any one of the grading lines 48 are correlated with each other as groups and the groups are labeled by e.g. alphabets, respectively. Also, a ratio 69 of deviation resulting from the modification is set for each of the correlated multiple grading lines 48.

In the sweater of seamless knitted fabric having the design as shown in FIG. 4, the sleeves 38 are joined to the bodies 36, 40 by connecting the narrowing parts 54 of the sleeves to the armhole parts 56 of the bodies. In this process, the sleeve width and the number of stitches in the armhole length must be considered. If not, the sleeves 38 and the bodies 36, 40 will be joined badly.

In this embodiment, the grading lines 48*c*, 48*d* are correlated with each other in the narrowing parts 54 of the sleeves and the armhole parts of the bodies. The deviation ratio of the grading lines 48*c*, 48*d* varies depending on the shape of the sleeve. For example, a T-sleeve will have a 1:2 deviation ratio; a set-in sleeve will have a 1:2 deviation ratio; and a raglan sleeve will have a 1:1 deviation ratio.

When the grading line 48*c* is set at a deviation ratio of 1.0 and the grading line 48*d* is set at a deviation ratio of 2.0, the insertion of e.g. four stitches in the grading line 48*c* results in the insertion of eight stitches in the grading line 48*d*.

While in the embodiment, a deviation ratio resulting from the modification is set for the correlated multiple grading lines, what is set may be a deviation rate determined by mathematical expressions or equivalent, in addition to the deviation ratio. For example, where C is a revised value of a grading line c, a revised value D of a grading line d may be set as 2×C.

In the step s6, the process of resizing the design 34 is performed in the operating part 26 on the basis of the information on the design modification specified in the grading line directing part 24 and set in the grading line setting part 28. The design 34 after changed in size is illustrated in FIG. 6.

Figure 6:
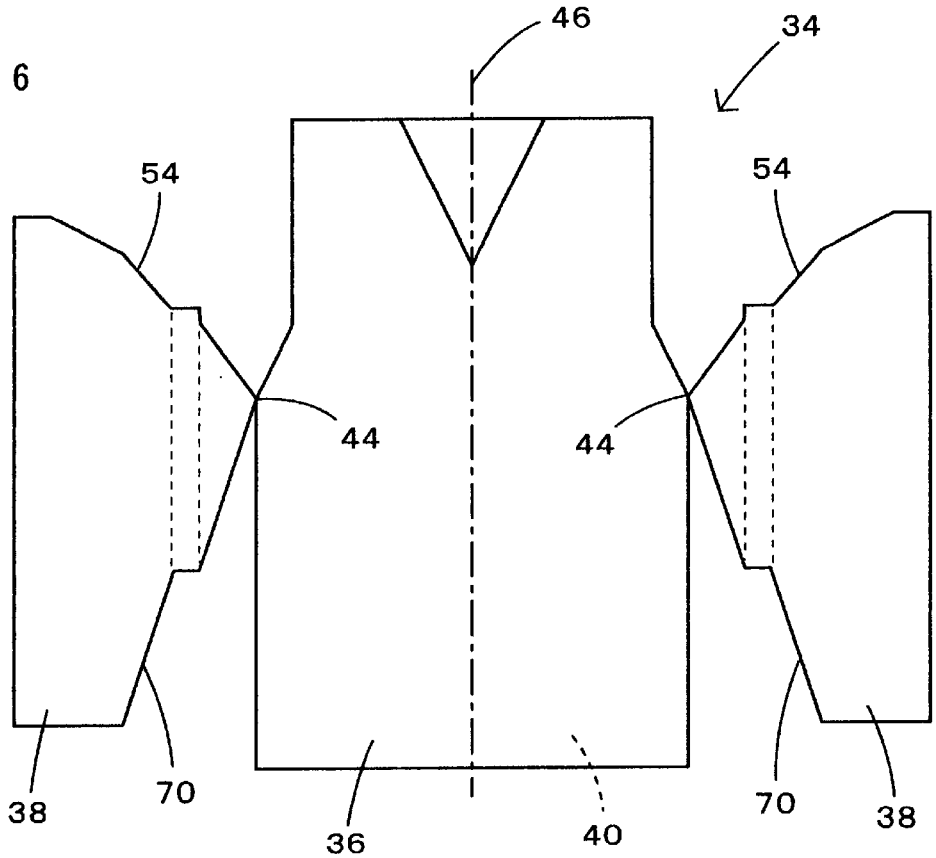
FIG. 6 shows the design whose profile line was transformed into an irregular outline after resizing.

When the design 34 is changed in size in the step s6, irregular profile lines are produced in the narrowing parts 54 of the sleeves and widening parts 70 of the sides, as shown in FIG. 6. In the step s7, those irregular profile lines in the design area are transformed to the regular profile lines by the line transforming part 30.

Figure 7:
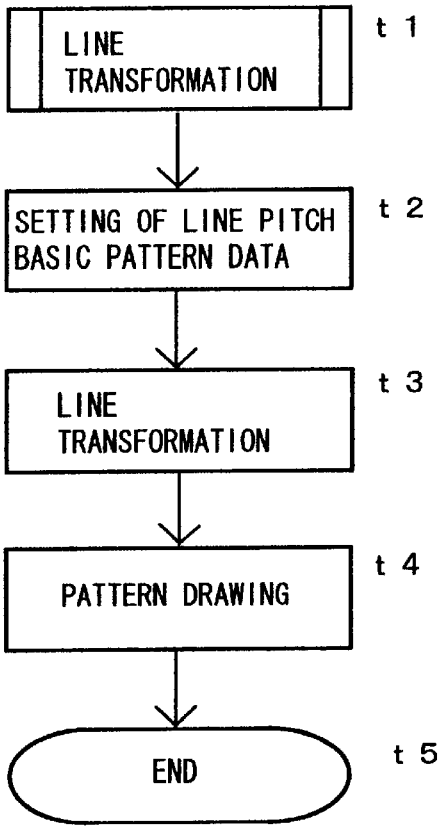
FIG. 7 is a flow chart of a line transforming process.

The flowchart of this line transformation process is shown in FIG. 7. In the step t1, the line transformation process starts.

Figure 8:
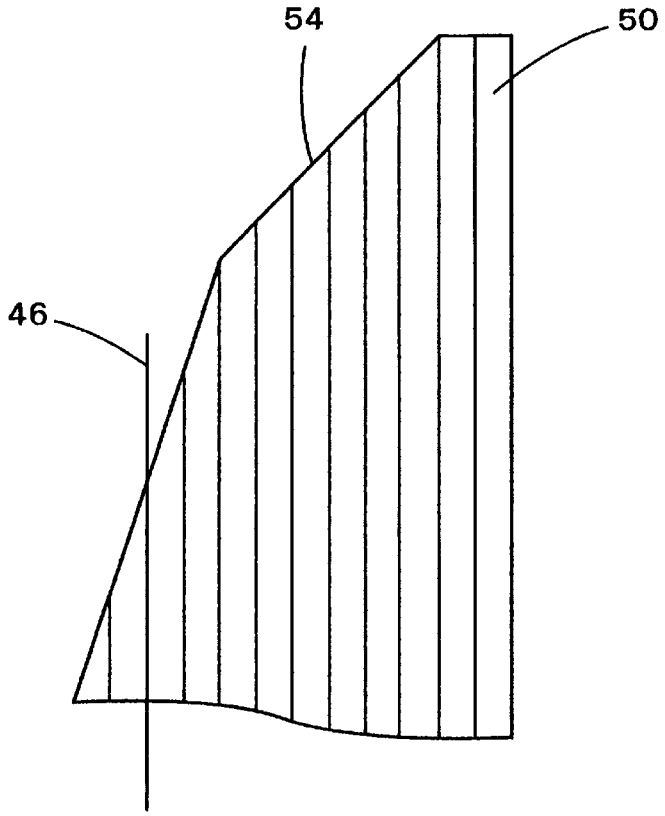
FIG. 8 shows a sleeve narrowing part of a sleeve cap before resizing.
Figure 9:
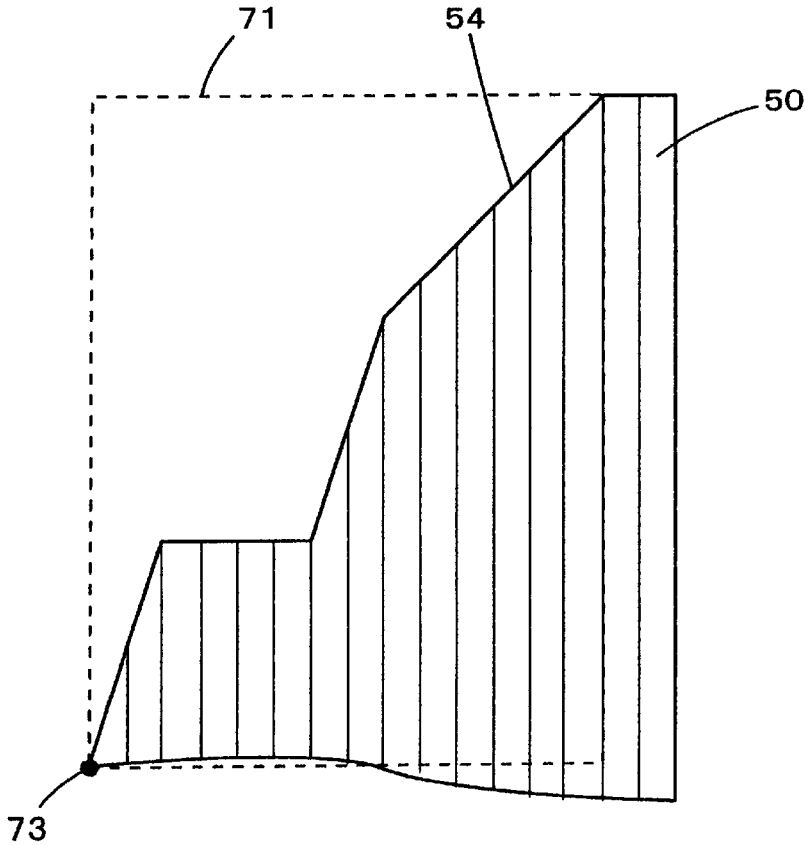
FIG. 9 shows the sleeve narrowing part whose profile line was transformed into an irregular outline by the size change.
Figure 10:
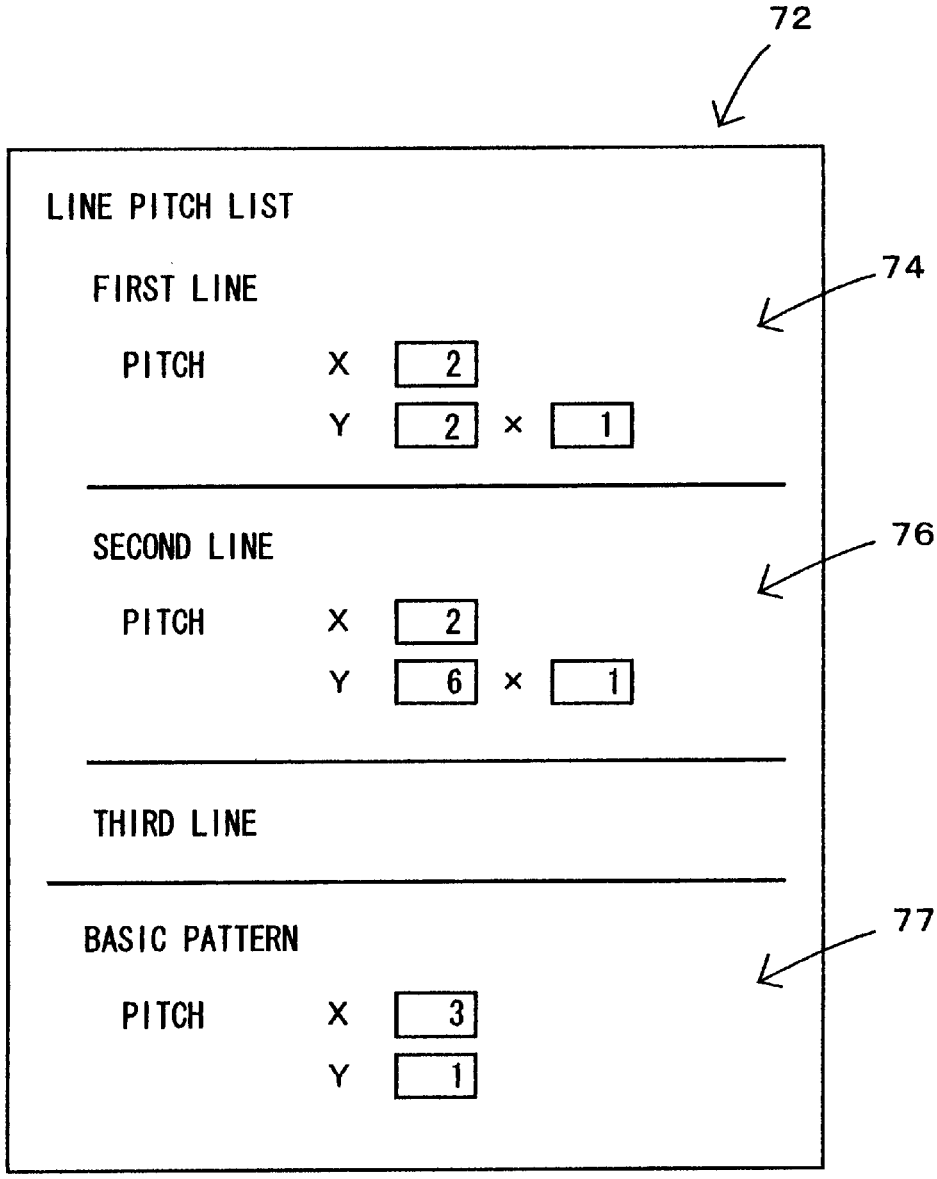
FIG. 10 is a line pitch list used for setting the profile line, for line transformation.

FIG. 8 shows the narrowing part 54 of the left sleeve cap 50 connected with the body 36, 40 whose design 34 is not yet changed in size. At this time, the narrowing part 54 of the sleeve has a regular profile line. FIG. 9 shows the narrowing part 54 of the sleeve in which an irregular profile line is produced by the insertion of the data in the widthwise direction of the sleeve for the size change.

In the step t2, an area 71 is taken in such a manner as to include the irregular profile line to be transformed, first. Then, the setting is made on how the irregular profile line produced by the data modification is transformed to a line having a desired pitch by using a line pitch list shown in FIG. 10. In the embodiment, a two-stage line transformation using two lines of a first line 74 and a second line 76 is performed to transform the irregular profile line to a regular profile line. First, the X-axis pitch and Y-axis pitch of the first line 74 are entered in the line pitch list. The Y-axis pitch is set as a minimum pitch. The Y-axis pitch can be varied by a multiple of the minimum pitch.

Similarly, the X-axis pitch and Y-axis pitch of the second line 76 are also entered in the line pitch list. The inclination of the first line and the second line can be varied by changing the Y-axis pitch. While two lines are set in this embodiment, more than two lines may be set for the line transformation process.

In this embodiment, the X-axis pitch of the first line 74 is set at 2, the Y-axis of the first line 74 is set at 2, the X-axis pitch of the second line 76 is set at 2, and the Y-axis pitch of the second line 76 is set at 6.

In addition, the X-axis pitch and Y-axis pitch of the ground part of the knitted fabric are set as basic pattern information 77 on the pattern of the knitted fabric. In this embodiment, the X-axis pitch of the basic pattern is set at 3 and the Y-axis pitch of the basic pattern is set at 1. This data is used in the pattern drawing part 32.

Figure 11:
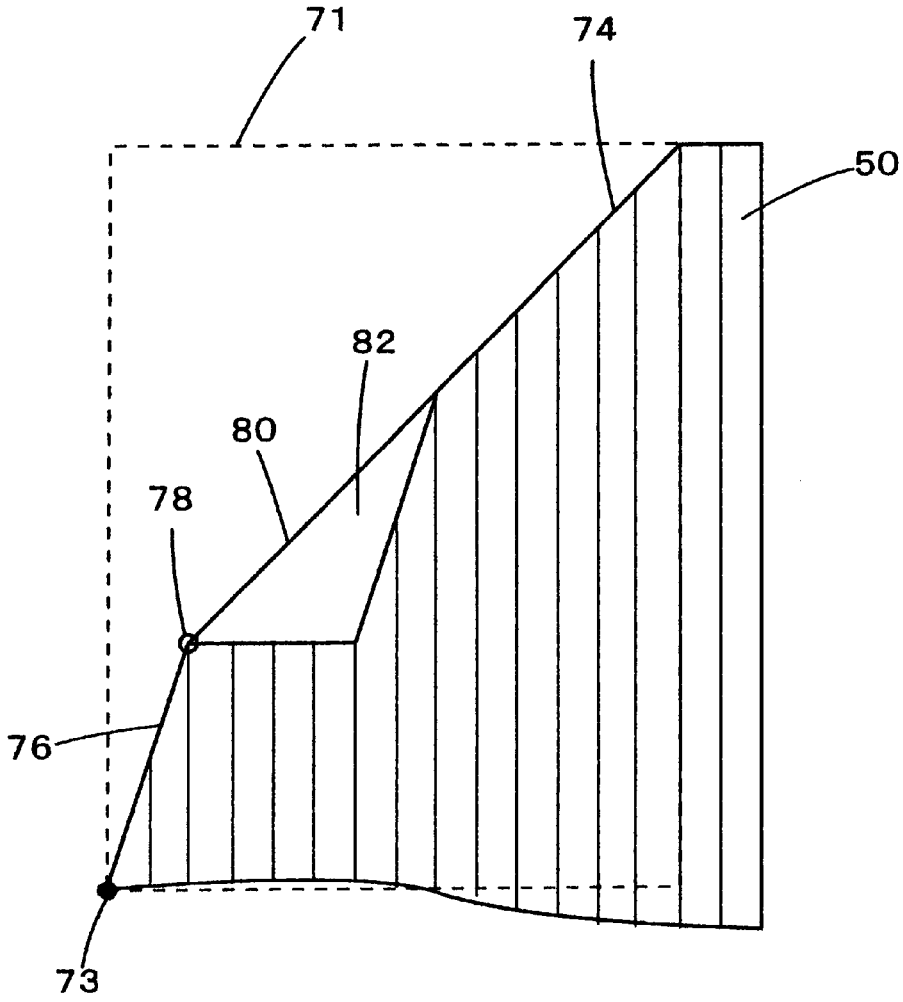
FIG. 11 shows the sleeve narrowing part whose profile line was transformed into a regular outline by the line transformation.

In the next step t3, the irregular profile line is transformed to the regular profile line automatically by the line transforming part 30 under the line pitch list 72 set in the step t2. FIG. 11 shows a transformed profile line in the area 71 into which the profile line of the design of FIG. 9 was transformed. In this embodiment, a round mark 78 is displayed in the specified area 71. When a profile line 80 automatically transformed by the design system 1 is not a desired line, the operator may amend the profile line by moving the round mark 78 displayed in the area with the stylus 18 or equivalent. That profile line is then amended with reference to the pitches of the first line 74 and second line 76 set in the line pitch list 72.

If the line transformation cannot be achieved on the basis of the pitches of the first line, the second line and the like set in the line pitch list 72, then e.g. an origin 73 of the second line is moved along a lengthwise direction of the design 34 so that the line transformation set in the line pitch list 72 can be realized.

In the step t4, if a modified design 34 part whose profile line is transformed to the regular profile line by the line transforming part 30 has, at a pattern side of the profile line, an area 82 where no data is input, then that area 82 is filled in with a pattern with reference with the preset basic pattern information of the fabric. The design 34 can then be additionally filled in with shaping data, such as data on narrowing or widening.

If the pattern depicted in accordance with the transformation of the profile line protrudes from the profile line, then the data on the pattern protruding from the profile line is deleted.

The data on the grading line set in the size change process and the data on design modification are stored as grading data in the design storage part 4 and the like. This can provide the result that when the size of the design is changed again, the size change process can be facilitated by opening the previously created grading data. Also, this grading data can be used for the size change process of another knitted fabric of the same size.

The line transformation process moves on to the next step t5 and is ended in the step t5. Then, the process moves back to the steps of FIG. 2 and the size change process is ended in the step s8.

This line transformation process based on the pitches of at least two lines of the first line 74 and the second line 76 can create an approximated profile line of the design 34 before changed in size.

Next, another embodiment of the present invention will be described.

In the first embodiment, a ratio of deviation resulting from the modification is set for each of the correlated multiple grading lines 48 among the grading lines 48 specified in the grading line directing part 24.

Figures 12, 13:
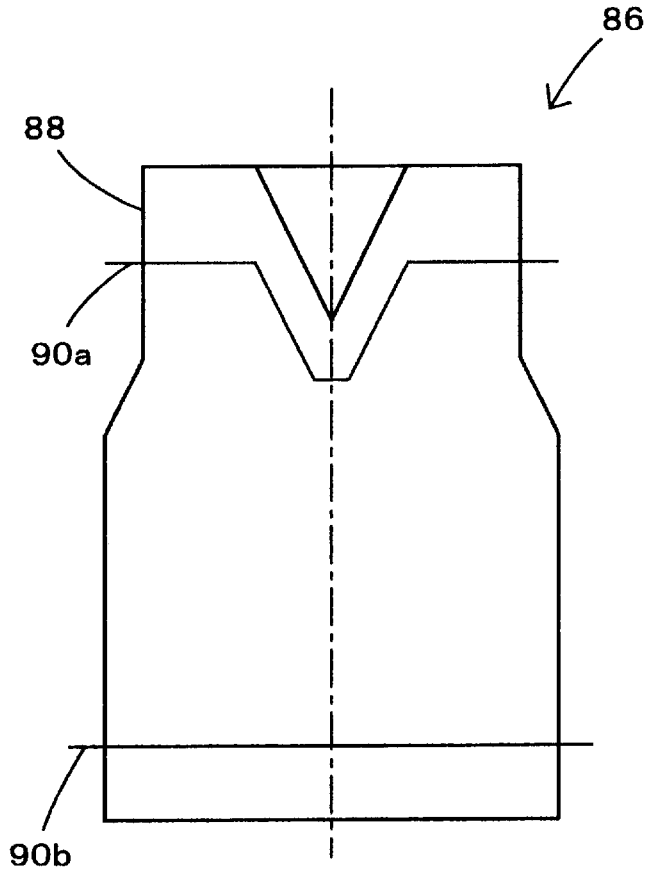
FIG. 12 shows a design to be resized in the second embodiment.
FIG. 13 is a size list used for setting displacement of the design in the second embodiment.

In the second embodiment, other means than the ratio of deviation resulting from the modification to be set for the correlated multiple grading lines 48 is used to set an amount of deviation. In the second embodiment, the design of the sweater of the seamless knitted fabric (sleeves are omitted) shown in FIG. 12 is changed in size.

For example, when armhole parts 88 are desired to increase in size by 2 cm without changing the body length of the design 86, grading lines 90*a*, 90*b* are depicted in the design 86 at its armhole parts 88 and its body parts below the armhole parts 88, respectively. Also, with reference to a size list 84 shown in FIG. 13, the difference in body length is set at 0 and the difference in armhole 88 length is set at +2 cm. The design system 1 sets a rate of deviation for each of grading lines 90*a*, 90*b* with reference to these settings. The size changes by the operating part 26 permit the armhole length to increase by 2 cm with respect to the grading line 90*a* and also permits the body length to decrease by 2 cm with respect to the grading line 90*b*.

Although description was made in this embodiment by referring to the body part only, the grading lines specified for the sleeves in the size list 84 can also be processed in the same manner. The size changes of the sleeves (not shown) with respect to the grading line specified in the Y-axis are also made in association with the size changes of the armholes 88 with reference to the grading line 90*a*.

Although the grading lines 48, 90 are specified by the operator in the embodiments described above, modifications may be made in these embodiments such that a plurality of grading lines can be automatically specified in the locations serving as the basis for the size changes made by the design system 1 side and also a grading line can be added or deleted or can be changed in location by the operator when needed.

Although the grading lines are specified at the locations of size changes so that orientations of the size changes of the design can be seen in the embodiments, grading means is not necessarily limited to the grading line. Any grading means will do, as long as they can indicate the orientations of the size changes of the design, for example, at the referential locations of size changes.

In addition, the pattern pitch, the profile line pitch, and the like of the design set in the grading line setting part 28 and the line transforming part 30 may be analyzed and determined by the design system 1 so that the values thereon can be automatically set by the design system.

Although the size changes of the design of the sweater of the seamless knitted fabric have been described in the embodiments, the present invention is effective for the knitted fabric which is knitted on a part-by-part basis or whose parts such as front body and sleeve are knitted separately, as well as for the seamless knitted fabric.

While preferred embodiments of the invention have been illustrated above, it is to be understood that the present invention is not limited thereto but may be practically be embodied variously within the sprit and scope of the present invention.

Capabilities of Exploitation in Industry

According to the present invention, the size modification of the design is made on the monitor on which the design of the knit product is displayed. The grading line directing means directs the grading line at the locations of the size changes. The grading line setting means sets the modification data of the design with respect to the respective grading lines. The size changes of the design are made with reference to the grading line directed by the grading line directing means and the modification data set by the grading line setting means. This can provide the advantages that there is no need for the operator to make modifications at the locations of size changes separately and that there is no need for the operator to consider the constraints on the knitting and the information on the knitting structure, thus facilitating the size changes of the design.

Also, the grading line setting means can allow the correlation of the grading lines that are mutually affected by the size changes and can also allow the setting of a ratio of deviation for each of the correlated grading lines. This can allow the automatic calculation of a revised value of the other grading line by setting a revised value of any one of the correlated multiple grading lines.

Also, the profile line transforming means can allow the transformation of an irregular profile line caused by the size changes of the design to a regular profile line with reference to the set values by setting a desired profile line pitch.

Also, the pattern drawing means can depict a pattern in a design area at the pattern side of the profile line as was transformed in the line transformation process with reference with the basic pattern of the pattern of the design.

What is claimed is:

1. A knit design system capable of displaying a design of a knit product on a monitor to make size changes of the design, the knit design system comprising:

grading line directing means for directing grading lines at locations of size changes with respect to the design displayed on the monitor;

grading line setting means for setting information on design modification with respect to the grading lines directed by the grading line directing means;

operating means for making size changes of the design with reference to the grading line directed by the grading line directing means and the information on design modification set by the grading line setting means; and profile line transforming means for transforming an irregular profile line in an area of the design changed in size by the operating means to a regular profile line.

2. The knit design system according to claim 1, wherein the grading line setting means allows correlation of the grading lines that are mutually affected by the size changes among the grading lines directed by the grading line directing means and also allows a setting of a ratio of deviation for each of the correlated grading lines.

3. The knit design system according to claim 1, which further comprises pattern drawing means for depicting a pattern in the area of the design at the pattern side of the transformed profile line with reference with a basic pattern of the pattern of the design after the profile line of the design is transformed by the line transforming means.

* * * * *